United States Patent [19]

Strand et al.

[11] 4,420,021

[45] Dec. 13, 1983

[54] METHOD AND APPARATUS FOR FILLING OF FLEXIBLE CONTAINERS

[75] Inventors: Olaf Strand; Bjarne Omdal, both of Porsgrunn; Jens Svendsen, Hosle, all of Norway

[73] Assignee: Norsk Hydro A/S, Oslo, Norway

[21] Appl. No.: 308,854

[22] Filed: Oct. 5, 1981

[30] Foreign Application Priority Data

Dec. 16, 1980 [NO] Norway ..... 803784

[51] Int. Cl.[3] ..... B65B 1/06

[52] U.S. Cl. ..... 141/10; 141/114; 141/314

[58] Field of Search ..... 141/10, 114, 166, 271, 141/281, 313–317, 369, 372, 377

[56] References Cited

U.S. PATENT DOCUMENTS 2,853,105 9/1958 Brown ..... 141/10 X 4,182,386 1/1980 Alack ..... 141/314 X

FOREIGN PATENT DOCUMENTS 2022545 5/1979 United Kingdom .

*Primary Examiner*—Frederick R. Schmidt

*Attorney, Agent, or Firm*—Wenderoth, Lind & Ponack

[57] ABSTRACT

A method and an apparatus for filling bulk material into flexible containers. The filling is carried out through a filling pipe or spout while the container is hanging on a hook. The impervious part of the container, which may be in form of an inner bag, is fastened around the spout and kept in place during the filling operation without any special fastening means. This is obtained by first hanging at least one lifting loop on the hook before the pipe is put into the container. Then the remaining loops are hooked onto the hook during simultaneous or subsequent filling of the container with air. The loops are secured together while the container is hanging on the hook. Thus, the container will be made ready for further transport as soon as it is filled and its impervious bag is closed. The apparatus comprises a batch weigher, storage bin having an outlet into a funnel with a pipe for supplying air. The funnel is connected to a filling pipe which is horizontally movable and placed close to a holding device comprising the hook which is movable both horizontally and vertically.

9 Claims, 4 Drawing Figures

METHOD AND APPARATUS FOR FILLING OF FLEXIBLE CONTAINERS

BACKGROUND OF THE INVENTION

The present invention relates to a method for filling flexible containers having at least two lifting loops, and an apparatus for carrying out the method which also comprises making the filled container ready for transport.

The container is hung up by its lifting loops and blown up with air before it is filled with bulk material from a storage bin. The container is filled while it is hanging in such a position that most of the load is carried by the lifting loops during the filling operation, even though the container bottom touches a floor, conveyer belt or the like.

The apparatus comprises a funnel for filling of bulk material, a filling pipe, a pipe for supplying air and holding devices for the flexible container. Such apparatuses are usually equipped with some means for removing dust. The apparatus may also comprise a storage bin having a flap for emptying it and a batch weigher. The storage bin can also be connected to a large silo and/or supplying means for bulk material.

During the development of the flexible container it has been found that it is necessary to have filling methods and apparatuses adapted to the container in order to obtain optimal utilization of the container. The filling methods and apparatuses used for, for instance, 50 kilo bags have not been found applicable.

There already are some patents describing how these special problems can be attacked. British patent specification No. 1.475.019, describes a method and an apparatus for filling sacks having a volume of at least 250 liters. The sacks comprise an outer sack of strong load supporting material and an inner bag of impervious material. The filling pipe is put into the bag through its opening, which then surrounds the pipe at such a height above the floor, etc., that only the bottom of the sack rests on the floor. The inner bag is blown up by air before filling of the free-flowing material. By filling the inner bag with air it is pressed tightly against the outer sack which is standing upright, having maximum of its volume ready for filling, and without any special support. Filling of the free-flowing material is then carried out during complete or partial closure of the air supply. The apparatus used comprises a filling pipe, preferably telescopic, and it also comprises dust removing means and air supply means and a valve for regulating the supply of free-flowing material.

British patent application No. 2.022.545 relates to an apparatus for filling flexible containers. The container is first secured to at least two hooks by its lifting loops, and its inner bag is fastened to a fixed vertical down pipe around the filling pipe. The apparatus comprises means for hoisting or lowering the down pipe to which the bag is fastened. The filing pipe can be arranged in a stationary or movable supporting frame, the upper part of which is connected to a storage bin.

The apparatus according to the British patent has been used commerically for several years and has a large capacity, but in order to fully utilize this apparatus, several persons are needed to operate the apparatus and make the filled containers ready for transport.

The apparatus according to the British application is rather complicated and the required investment will be too large for small filling stations.

Fastening the container to the holding devices and connecting and disconnecting the inner bag will be laborious. To operate such an apparatus, including making the container ready for further transport, will also necessitate a relatively large amount of work for each container. In order to fully utilize the capacity of the apparatus, it should also be operated by several persons.

The increasing application of large flexible containers for transport of bulk material has created a need for filling apparatuses which both have a large capacity and at the same time are simple to operate and require few operators. Because the filling itself often is carried out at small distribution centers, it is important that the filling operation and the operation for making the container ready for further transport are simple. Large amounts of the goods packed in flexible containers are first transported in bulk from the plant to a distribution center, and these need apparatuses which can be applied to different types of goods and for flexible containers of different sizes.

SUMMARY OF THE INVENTION

The main object of the present invention is to provide an improved method for filling flexible containers and making them ready for further transport. The method should not necessitate complicated and expensive apparatuses, and the operation should be simple and not labour consuming. The total operation, filling and making the container ready for further transport, should require a minimum amount of work for each container.

Another object is to provide an improved apparatus for filling large flexible containers. The apparatus should be simple to operate and have a large capacity even when operated by only one person.

As mentioned above, the known solutions have certain disadvantages. On starting to find new solutions, it was decided to develop a type of apparatus to which the flexible container itself may hang by its lifting loops from only one specially designed hook during the filling operation. It was then found that the inner bag of the container could be connected to and disconnected from the spout (filling pipe) quite simply. The inner bag could thereby be kept around the spout both while it was blown up by air and during the filling operation without using special fastening means.

This implies that the process becomes less labour consuming and it simplifies the apparatus itself is simplified. The hook should be arranged such that it can be hoisted and lowered vertically. By designing the hook with a wide lifting part, the process for making the filled container ready for further transport also is simplified.

The relative positioning of the filling pipe to the hook and especially the design of the pipe and the hook are important regarding filling speed and the labour required. By means of the apparatus according to the invention it is for instance possible to put the inner bag quickly on to and off the filling pipe without damaging it. The apparatus also easily can be adapted to flexible containers of different sizes.

The special features of the invention are that only one or some of the container lifting loops are hung on a lifting hook, and then the filling pipe is put into the impervious part of the container which can be an impervious inner bag. The remaining lifting loop(s) is then hung on the lifting hook which thereupon is hoisted to a filling position while the container at the same time is blown up with air, as known per se. The impervious part of the container is kept around the filling pipe by the lifting loops which are fastened together while the main part of the container load rests on the lifting hook. The filled container is then lowered onto a conveyer or the like with all its weight, and a complete closure of the bulk material in the container is then carried out. The container is thereby completely ready for further transport.

The special features of the apparatus according to the invention are that the filling pipe or its lower part can be moved horizontally and that the holding means comprises a wide or hoop formed hook which is arranged against the filling pipe at such a distance that the hook is pressed against the filling pipe when it is hoisted from its lowest position. The hook can be moved both horizontally and vertically.

In a preferred construction of the apparatus, the filling pipe is fastened to the funnel by means of a flexible bellow. It is permanently fastened to the funnel by means of a bolt which goes through a bracket projection on the funnel. The lower part of the bellow is removably fastened to the bracket on the filling pipe by means of bolts and nuts.

The hook used in the apparatus is preferably fastened by means of an interchangable rod to a lifting cylinder which is connected to a bar via a universal joint or the like.

The hook itself preferably has a hoop shape, where the hoop can be lowered down by opening the hook and in closed position is kept in position by means of a pin fastened to a bushing in the upper part of the hook.

BRIEF DESCRIPTION OF THE DRAWINGS

The invention will now be further explained with reference to the accompanying drawings, wherein.

DETAILED DESCRIPTION OF THE INVENTION

Figure 1:
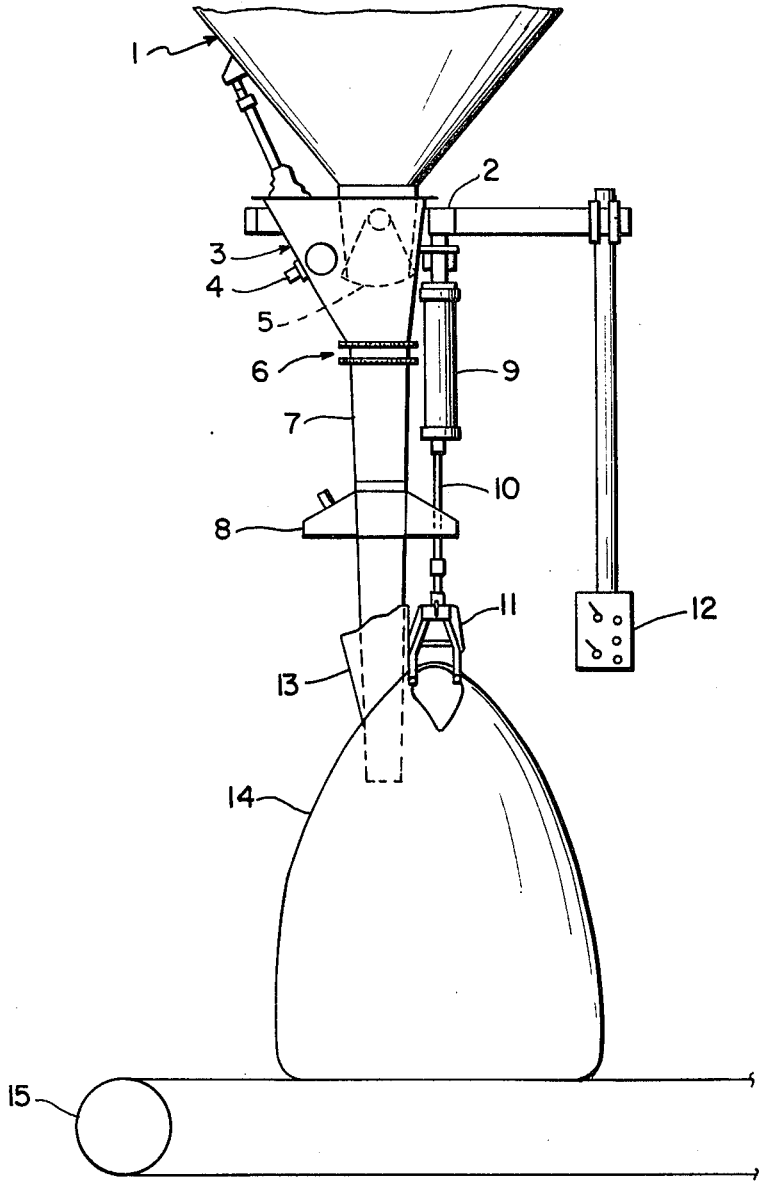
FIG. 1 is an elevation view of an apparatus for filling bulk material.

In FIG. 1 is shown an apparatus according to a invention, and the flexible container (14) is shown in the position it has during filling. A bin (1) for bulk material is preferably a weighing container wherein the amount which is to be filled in the container is weighed. A silo or conveyer for supplying bulk material is usually connected to the bin (1), which can be emptied into a funnel (3) by means of a flap (5). The funnel (3) may be equipped with dust removing means (4) which also may comprise supply pipes for air for blowing up the inner bag. The funnel (3) is shown connected with a filling pipe (7) by means of a bellow (6). A dust removing unit (8) may be arranged around the pipe (7). Unit (8) can be moved somewhat vertically and can also be connected to a central suction device.

A bar (2) is arranged in a frame (not shown), and to this bar is fastened the filling apparatus itself. To the bar (2) is also fastened a lifting- or holding device which may consist of a cylinder (9), a rod (10) and a hook (11). An operation panel (12) may also be fastened to the bar (2). During filling of bulk material an inner bag (13) is put onto the pipe (7) and the container (14) hangs down against a conveyer (15).

Figure 2:
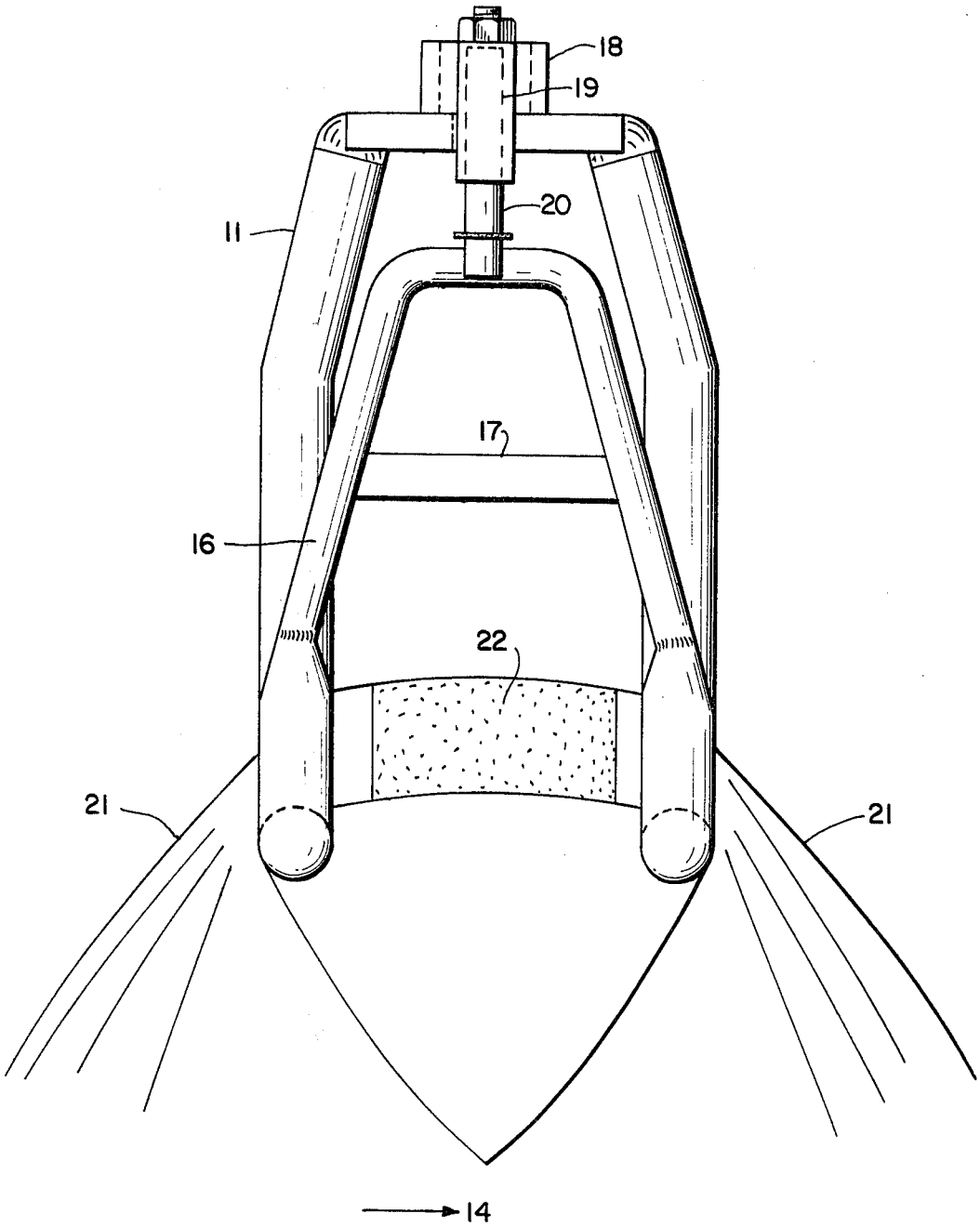
FIG. 2 is a front view of the hook of the apparatus.

In FIG. 2 is shown a front view of the hook with the flexible container (14) after having been filled and made ready for further transport. In this figure is shown a flexible container (14) having integrated lifting loops (21), and these are fastened together with a tape (22). The hook (11) is in the form of a fixed support member with a bracing rod (17) between the rear parts of the hook. The hook is opened by lowering the hook-shaped pivotal member (16). The hook is shown in the closed position and the part (16) is kept in such position by means of a retaining pin (20) which when opening the hook is pushed up slidably through a bushing (19). The hook is fastened to the rod (10) with a pin through a pin fastening device (18).

Figure 3:
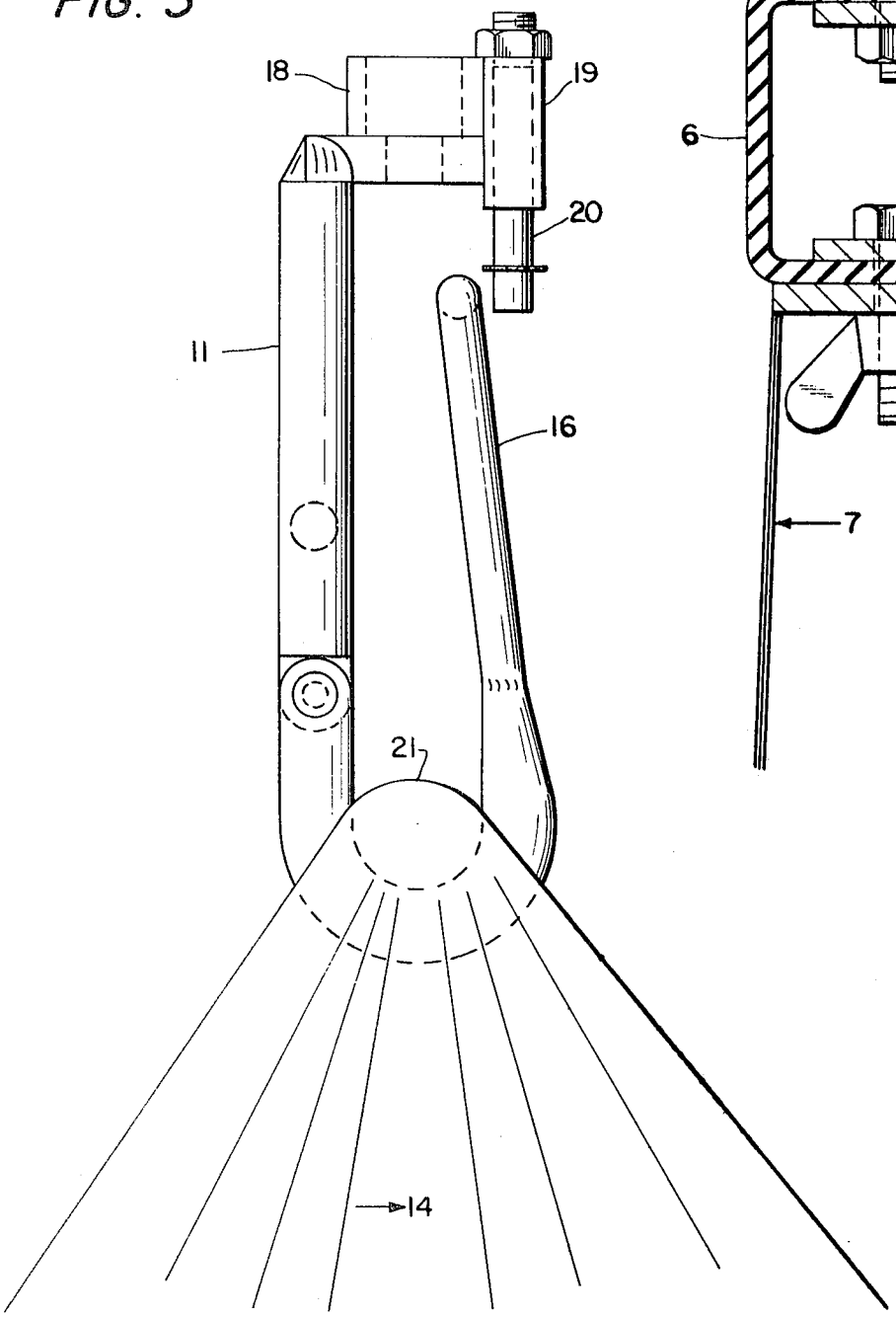
FIG. 3 is a side view of the hook.

In FIG. 3 the hook is seen from the side and in the closed position. In the open position the hoop (16) will be in a substantially horizontal position and a lifting loop (21) can easily be put on to the hook.

Figure 4:
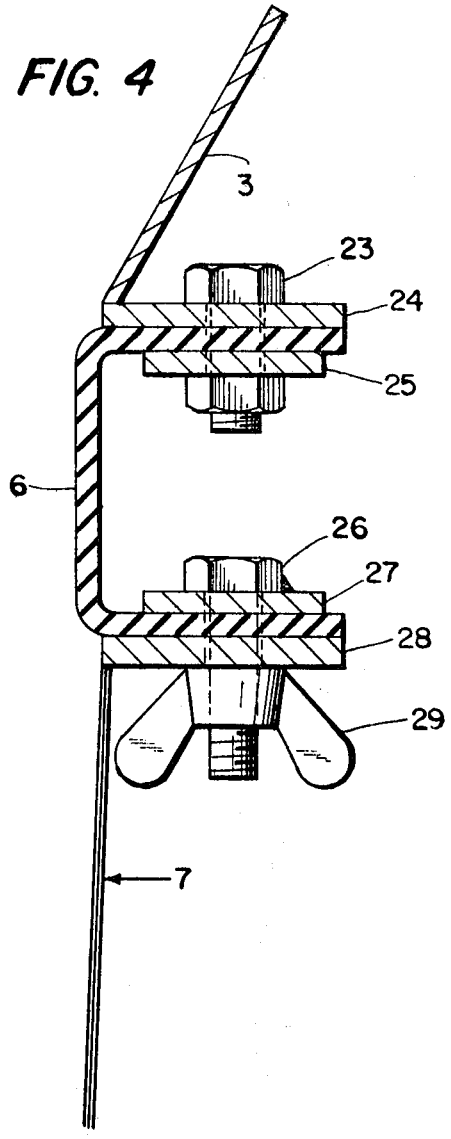
FIG. 4 is a section showing the connection of the filling pipe and the funnel for supplying bulk material.

FIG. 4 shows how the filling pipe (7) is connected to the funnel (3). A bellow (6), for instance of semi rigid but still flexible rubber, is fastened permanently to the funnel (3) by means of bolts (23) passing through a bracket projection (24) of the funnel (3) and a circular disc (25). The filling pipe (7) also has a bracket projection (28) fastened to the bellow (6) by means of bolts (26) which pass through a circular disc (27). The pipe is kept in position by means of a butterfly nut (29). The pipe (7) can easily be changed by losing the butterfly nuts (29).

The flexible container can be filled and made ready for further transport in the following manner.

The hook (11) is hoisted by means of cylinder (9) up to a central position, and one of the lifting loops is fastened to the hook. The opening of the inner bag is drawn out and put on to the filling pipe (7) and some air is blown into the bag, whereupon the other lifting loop is fastened to the hook. The hook with the flexible container is now hoisted up to filling position, and at the same time the inner bag is blown completely up by air. The inner bag is pressed tightly against the filling pipe by the lifting loops. The supply of air is stopped and the flap (5) is opened, and pre-weighed bulk material is filled into the flexible container while it is hanging in the upper position. This means that approximately the entire load of bulk material is carried by the lifting loops and the hook while the container bottom merely touches the conveyer (15). During the filling operation itself the lifting loops are fastened together, for instance by a tape (22) (FIG. 2). When the container (14) is filled, it is lowered so that all its weight rests against the conveyer (15). The lifting loops (21) are released from the hook, whereupon the inner bag (13) is closed. This closing of the bag can be carried out in different ways, including welding. The inlet part of the inner bag is placed inside the outer container during or right after closing of the opening.

The inner bag can be fastened to the joined lifting loops by means of a thread. One end of the thread is put on to the hook before the first lifting loops are hooked on, and during joining of the lifting loops this end will be fastened thereto. The other end of the thread is fastened around the upper part of the inner bag during its closure. When the container is emptied, the thread will tighten and prevent the inner bag from falling out of the discharge opening in the container bottom.

The conveyer belt (15) then moves the filled container away from the filling apparatus, and it is then ready for being lifted away. A hook from a crane or a fork from a truck can be put directly in under the joined lifting loops (21) without the need for an extra operator for this operation.

For optimal adjustment of the filling apparatus to flexible containers of different sizes, the filling pipe (7) and the lifting rod (10) can be changed. When employing the largest type of containers (14) the hook (11) can be connected directly to the lifting cylinder (9).

When the filling pipe has to be changed, the butterfly nuts (29) are loosened and a shorter or longer pipe (7) is then fastened to the bellow (6), as shown in FIG. 4. The bellow (6) is sufficiently flexible to allow the pipe (7) to move somewhat horizontally. It has been found that this is very important in order to avoid damage to the inner bag during filling of bulk material. During the filling operation the inner bag (13) and the pipe (7) are pressed against the hook (11), but because the pipe can give way to this pressure the inner bag will only be pressed against the pipe and not rubbed or torn apart.

This horizontal movement of the pipe (7) can of course be obtained in different ways, for instance by making the pipe (7) or its lower part from a flexible material like plastic or rubber. However, it has been found most practical to have a rigid pipe (7) and a flexible bellow (6).

The cylinder (9) is fastened to the bar by means of a universal joint such that the cylinder with the rod (10) and the hook (11) can be moved horizontally. These possiblities for movement are of the greatest importance when the lifting loops are put on or removed from the hook.

By using the method and the apparatus according to the invention it has been possible to fill flexible containers and make them ready for further transport in a simpler and less labour consuming way than previously known. Thus the apparatus according to the invention can be operated by one person only, contrary to the apparatus according to the above mentioned British patent, which requires three persons in order to utilize its full capacity. The apparatus also makes it possible to make the filled containers ready for further transport in a more efficient and suitable way.

Investment is relatively low, because the apparatus is simple and does not require a large space. This advantage can easily be seen by comparing this apparatus to the one according to the above mentioned British application. The filling pipe can be moved horizontally, for instance by using a flexible bellow between the filling pipe and the funnel from the weighing bin. Thus, the inner bag can be connected to and disconnected from the filling pipe, and at the same time it is not exposed to damaging stress during the filling operation. The simple adaption of the apparatus to flexible containers of different sizes makes it more versatile than known apparatuses.

We claim:

1. A method of filling bulk material into an inner bag of a flexible container of the type having plural lifting loops, said method comprising:

hanging a first said lifting loop on a hook;

inserting a bulk material filling pipe into an opening in an upper portion of said inner bag;

hanging a second said lifting loop on said hook;

raising said hook to a filling position, and filling said inner bag with air, thereby causing said lifting loops to press said upper portion of said inner bag tightly against said filling pipe;

filling bulk material through said filling pipe into said inner bag, while supporting substantially the entire weight of the thus filled flexible container by said hook;

joining said first and second lifting loops together;

lowering said hook until said filled flexible container is not supported by said hook;

removing said hook from said joined lifting loops; and closing said opening in said inner bag.

2. A method as claimed in claim 1, wherein said lowering comprises depositing said filled flexible container on a conveyor, by which said filled flexible conveyor is further transported.

3. A method as claimed in claim 1, further comprising, during said steps of raising and filling, allowing substantially horizontal movement of said filling pipe.

4. An apparatus for filling bulk material into an inner bag of a flexible container of the type having plural lifting loops, and apparatus comprising:

a funnel for the supply of bulk material;

a bulk material filling pipe having a lower end adapted to be inserted into an opening in an upper portion of an inner bag of a flexible container to be filled;

means for connecting said filling pipe to said funnel such that at least said lower end of said filling pipe is movable horizontally;

hook means for supporting first and second lifting loops of the flexible container to be filled in such a manner that such lifting loops are brought together, said hook means comprising a single hoop supporting both such lifting loops; and hoisting means for raising said hook means to a filling position at a location such that the lifting loops supported by said hook means press the upper portion of the inner bag tightly against said filling pipe.

5. An apparatus as claimed in claim 4, further comprising means for supplying air through said funnel and said filling pipe and thus for filling said inner bag with air.

6. An apparatus as claimed in claim 4, wherein said connecting means comprises a flexible bellow connected to said funnel and removably fastened to said filling pipe.

7. An apparatus as claimed in claim 4, wherein said hoisting means comprises a lifting cylinder connected to a fixed structure by means of a universal joint, and a rod extensibly mounted in said cylinder and fixed to said hoop.

8. An apparatus as claimed in claim 4, wherein said hoop comprises a support member, a hook-shaped member mounted on said support member for pivotal movement between a closed position and an open position, and retaining means for releasably maintaining said hook-shaped member in said closed position.

9. An apparatus as claimed in claim 8, wherein said retaining means comprises a pin slidably supported in said support member.

* * * * *